US005786755A

United States Patent [19]

Cicchino et al.

[11] Patent Number: 5,786,755

[45] Date of Patent: Jul. 28, 1998

[54] ALARM ESCALATION METHOD

[75] Inventors: Domenic A. Cicchino; Stephen M. Milton, both of Freehold, N.J.

[73] Assignee: AT&T Corp, Middletown, N.J.

[21] Appl. No.: 799,717

[22] Filed: Feb. 12, 1997

[51] Int. Cl.[6] ..... G08B 29/00

[52] U.S. Cl. ..... 340/506; 340/511; 340/521; 340/526

[58] Field of Search ..... 340/506, 511, 340/519, 521, 522, 523, 526, 529, 309.15; 364/139, 141

[56] References Cited

U.S. PATENT DOCUMENTS 4,528,533 7/1985 Hastings ..... 340/526

4,568,924 2/1986 Wuthrich et al. ..... 340/587

5,493,273 2/1996 Smurlo ..... 340/529 X

*Primary Examiner*—Thomas J. Mullen, Jr.

*Assistant Examiner*—Daryl C. Pope

*Attorney, Agent, or Firm*—Robert B. Levy

[57] ABSTRACT

Ordinary alarm conditions are escalated into a critical alarm condition by first accumulating the ordinary alarm conditions. Upon each ordinary alarm condition, a number of previously accumulated alarm conditions are deleted in accordance with the elapsed time since the last alarm condition. When the number of accumulated alarm conditions (less those deleted) exceeds a threshold, a critical alarm condition is then generated.

6 Claims, 1 Drawing Sheet

ALARM ESCALATION METHOD

TECHNICAL FIELD

This invention relates to a method for escalating an accumulation of ordinary alarm conditions into a critical alarm condition.

BACKGROUND ART

Many complex systems possess the capability of generating alarm conditions when certain events occur. For example, in a telecommunications network, such as the type maintained by AT&T, platforms (processors) within the network generate alarm conditions when various malfunctions occur. For example, if the incoming power received by a platform from a battery plant is low, the platform will generate an ordinary alarm condition indicative of such a malfunction. Likewise, if the platform can no longer access one or more data bases containing the necessary information to process a call, the platform likewise will generate an alarm condition.

Typically, the alarm conditions differ in the degree of seriousness depending on the malfunction associated with each condition. For example, a life threatening event, such as a fire, will trigger a critical alarm condition, requiring immediate action. Conversely, an alarm associated with a low power level may only trigger an ordinary alarm condition, requiring attention, but not necessarily immediately. In facilities that are staffed with personnel, alarm conditions, regardless of their level of severity, usually do not go unacknowledged, although an ordinary alarm condition may not necessarily garner as rapid a response as a critical condition. However, a problem often exists in facilities when personnel are unavailable to monitor alarm conditions, such as after working hours in a staffed facility or in remote locations that are not staffed at all. Usually, ordinary alarm conditions do not automatically trigger action, in the form of an automatic page to alert personnel, as do critical alarm conditions In facilities where personnel are not available to monitor ordinary alarm conditions, such conditions may go unacknowledged for a period of time. Often, a succession of ordinary alarm conditions that go unacknowledged is followed by serious trouble. For example, a condition of low power that triggered a succession of alarms may ultimately result in a complete loss of to power, resulting in equipment shutdown.

Thus, there is a need for a technique for escalating a succession of ordinary alarm conditions into a critical alarm condition.

BRIEF SUMMARY OF THE INVENTION

Briefly, in accordance with the invention, a technique is provided for escalating a succession of ordinary alarm conditions into a critical alarm. The alarm escalation technique of the invention may best be described by analogy to a "leaky pail." As each alarm condition occurs, the condition is accumulated, in much the same way that a drip accumulates in a pail. As each alarm condition is accumulated, a preselected number of previously accumulated conditions are deleted in accordance with the amount of time since the last alarm condition occurred (i.e., a fraction of the accumulated drips are leaked from the pail). Once a prescribed number of alarm conditions have accumulated, then a critical alarm condition is generated. By deleting a prescribed number of previously accumulated alarm conditions, the occurrence of a single new alarm condition may not trigger a critical alarm condition. Rather, a prescribed number of subsequent alarm conditions must usually occur before a critical alarm is generated. The steps of: (a) accumulating alarm conditions, (b) deleting, upon each ordinary alarm condition, a number of previously accumulated alarm conditions in accordance with the elapsed time since the last alarm condition, and (c) generating a critical alarm when the number of accumulated alarm conditions (less those deleted) exceed a threshold, are carried out repeatedly.

The alarm escalation process of the invention does not require a timer or any process that must be periodically activated to remove accumulated alarm conditions. Rather, the process only becomes active when an ordinary alarm condition occurs which may then trigger a critical alarm condition once a prescribed number of ordinary alarm conditions have accumulated (less those deleted) since the last alarm condition occurred. Moreover, the alarm escalation technique of the invention is flexible because the values representing the prescribed number of accumulated alarm conditions, and the number of previously accumulated alarm conditions removed upon the occurrence of each alarm condition, can easily be varied.

DETAILED DESCRIPTION

Figure 1:
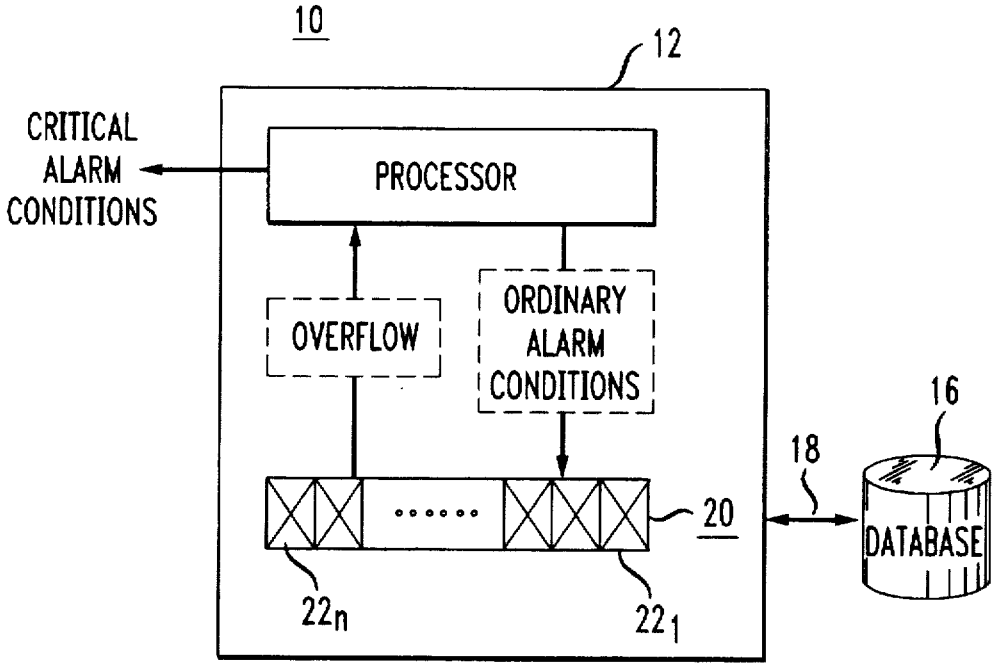
FIG. 1 is a block diagram of a system in which alarm conditions are escalated in accordance with the invention.

FIG. 1 depicts a system 10, such as a telecommunications network, that includes at least one platform 12, typically comprised of a processor 14. The platform 12 is coupled to a data base 16 via a trunk 18. During operation of the network 10, the processor 14 may accesses the data base 16 to gain information necessary to process traffic carried by the network.

The processor 14 signals malfunctions within the network 10 by generating an alarm condition. The severity of the alarm condition depends on the nature of the malfunction. For purposes of simplicity, the processor 14 generates ordinary alarm conditions and critical alarm conditions. However, it should be understood that the processor 14 could easily generate an entire hierarchy of alarm conditions. The processor 14 generates ordinary alarm conditions signal for a variety of malfunctions, such as low power, or an inability of the processor to access the data base 16. The processor 14 may generate a critical alarm condition when the processor becomes unstable.

A critical alarm condition is much more serious than an ordinary alarm condition. For that reason, a critical alarm condition occurring in an unstaffed facility will initiate an automatic telephone page to summon a technician. In contrast, an ordinary alarm condition, by itself, may not to be of a such a serious nature as to warrant such action. However, if no response is taken following an accumulation of ordinary alarm conditions, serious harm may occur. For example, if the processor 14 is unable to access the data base 16 for an extended period of time, a serious outage could occur, causing a loss of revenue and customer dissatisfaction.

In accordance with the invention, it is desirable to escalate an accumulation of ordinary alarms to a critical alarm condition when the sum of ordinary alarm conditions that have occurred less a calculated value since the last alarm exceeds a prescribed value. To that end, the platform 12 accumulates the ordinary alarm conditions, in an accumulator 20. It should be understood that it may not be necessary to physically provide a separate element, in the form of accumulator 20, for performing the step of accumulating ordinary alarm conditions. Rather, the accumulation functionality could easily be accomplished by the processor 14 itself or another element (not shown) in the platform. In other words, the accumulator 20 represents a functional element, not necessarily a physical one.

The manner in which the ordinary alarms are escalated into a critical alarm pursuant to the invention may best be appreciated by analogy to a "leaky pail." As each ordinary alarm condition occurs, the condition is accumulated in the accumulator 20, which in practice, comprises a plurality of cells $22_1$, $22_2$ . . . $22_n$ where n is an integer, each storing a bit indicative of an alarm condition.

Just as a pail (not shown) placed under a source of random water drips (not shown) collects drips of water, the accumulator 20 accumulates ordinary alarm conditions, each alarm condition corresponding to a drip collecting in the pail. When the accumulator 20 accumulates a prescribed threshold of ordinary alarm conditions, the accumulator 20 overflows (i.e., the count does not exceed an "overflow" value) signaling a critical alarm condition, just as the pail overflows once it has accumulated a sufficient number of drips. Using the pail analogy, as long as the pail has not overflowed, no action need be taken. Thus, as long as the accumulator 20 has not overflowed, the processor 14 does not generate a critical alarm condition.

With a conventional pail, each additional drip entering the pail will eventually will eventually cause it to overflow. Thus if the accumulator 20 wasn't periodically emptied (e.g., a calculated value substracted from the count, each ordinary alarm condition occurring after the accumulator 20 was full would trigger ordinarily another critical alarm condition which is undesirable. In accordance with the invention, ordinary alarm conditions accumulated in the accumulator 20 are regularly deleted, in much the same way that a leaky pail leaks drips of water previously accumulated in the pail. It is only when the rate of occurring alarms exceeds the deletion rate that an "overflow" condition could exist.

There are several possible approaches that could be employed to regularly delete alarm conditions from the accumulator 20. For example, the accumulator 20 could be accessed periodically and a prescribed number of alarm conditions that had previously accumulated could be removed. However, we have found it more useful, upon the occurrence of each alarm condition, to remove a calculated elapsed time alarm conditions from the accumulator 20 in accordance with the number of since the last alarm condition. The foregoing relationship is employed to determine how many ordinary alarm conditions to delete:

$$\text{amntToRemv}=((\text{Current GMT}-\text{lastAlrmGMT})/\text{AlrmThd})*\text{RmvAmt} \quad (1)$$

where:

amntToRemv is the number of alarm conditions to be deleted from the total number of alarm conditions accumulated by the accumulator 20;

Current GMT is the current time in seconds;

lastAlrmGMT is the time, in seconds, when alarm conditions were deleted from the accumulator;

AlrmThd represents an alarm condition threshold and corresponds to the time, in seconds, when an alarm condition should be deleted; and RmvAmt is the number of alarm conditions to be deleted from the accumulator 20 upon the occurrence of each alarm condition Equation (1) can be expressed more simplistically as $$\text{amntToRemv}=\text{AlrmOccrTimeLapse}*\text{AlrmDecayRate}$$

where $$\text{AlrmOccrTimeLapse}=\text{CurrentGMT}-\text{lastAlrmGMT}$$

and $$\text{AlrmDecayRate}=\text{RemvAmt}/\text{AlrmThd}$$

Once the number of alarm conditions to be deleted (amntToRemv) is computed in accordance with eq. (1), the number of alarm conditions in the accumulator 20 is reduced by this amount, thus yielding an accumulated alarm count in accordance with the following relationship:

$$\text{totAlarmCnt}=\text{totCnt}-\text{amntToRemv} \quad (2)$$

where totAlarmCnt initially contains the total number of alarm conditions accumulated in the accumulator 20 since the occurrence of the last ordinary alarm condition and after removing a prescribed number of alarm conditions in accordance with eq. (1). (The term totAlarmCnt, if less than zero, is set to zero, especially during the first iteration of the alarm escalation process.) and totCnt represents the total number of alarm conditions since the process was last invoked, including the last alarm condition Given that a prescribed number of alarm conditions are deleted, in accordance with eq. (1) upon the occurrence of each alarm condition, then after the occurrence of an alarm condition, the total alarm count (totCnt) stored in the accumulator 20 will be given by the relationship:

$$\text{toCnt}=\text{totAlarmCnt}+1 \quad (3)$$

so that the total count now reflects the latest alarm condition.

A critical alarm condition is generated when the following relationship is satisfied:

$$\text{AlrmLmt}\leqq\text{totCnt} \quad (4)$$

where:

AlrmLmt represents the threshold of accumulated ordinary alarm conditions above which a critical alarm condition should be generated.

Thus, if the total number of alarm conditions that have occurred (including the most recent condition), less the amount deleted in accordance with eq. (1), exceeds the threshold AlrmLmt, the accumulated ordinary alarms are escalated into a critical alarm condition.

Figure 2:
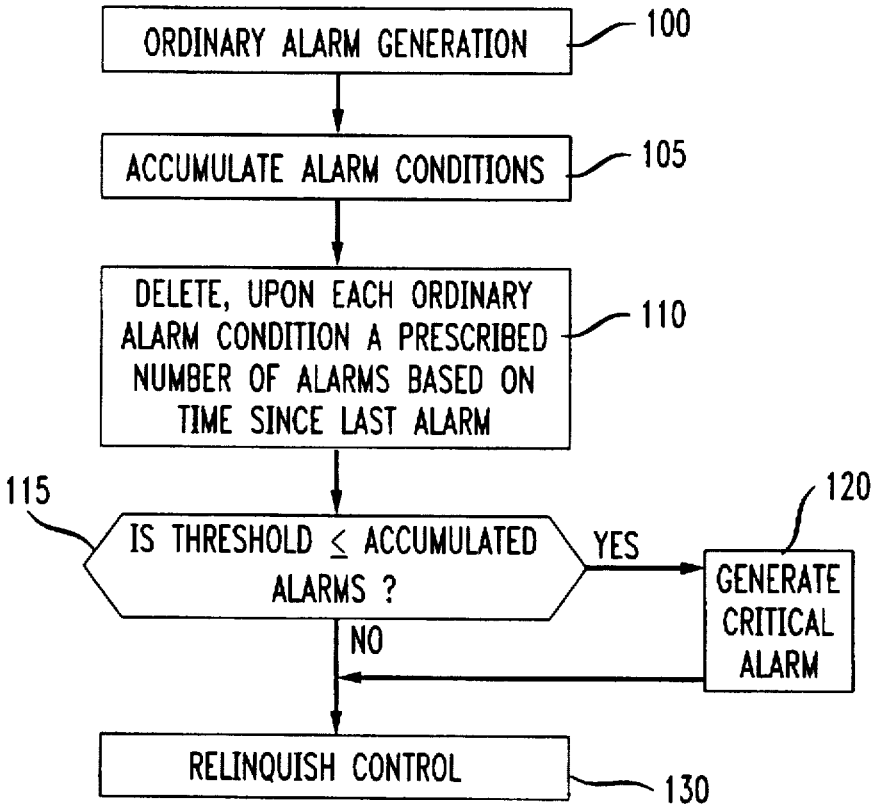
FIG. 2 is a flow chart representation of the alarm escalation process of the invention.

As best seen in FIG. 2, the alarm escalation process commences upon the generation of an ordinary alarm condition (step 100) following the occurrence of a malfunction. The ordinary alarm condition is then (accumulated with) the ordinary alarm conditions that have occurred previously (step 105). Upon each ordinary alarm condition, a number of previously accumulated alarm conditions are deleted in accordance with the elapsed time since the last alarm condition and an alarm decay rate (step 110). Thereafter, a determination is made (step 115) whether the accumulated alarm conditions (less those just deleted during step 110) exceed threshold value. If so, then a critical alarm condition is generated (step 120). Following step 120, or following a determination during step 115 that the accumulated alarm conditions do not exceed the threshold, then step 130 is executed and system control is relinquished. In practice, steps 100, 110, 115 and 130 are executed each time after an ordinary alarm condition occurs. Step 120 is executed only when the accumulated alarm conditions (less those deleted during step 110) exceed the threshold.

The above escalation process eliminates the need to assign resources to periodically monitor the accumulated alarm conditions. Rather, the above process is event-driven. Only when an ordinary alarm condition occurs is the process invoked, allowing system resources to be dedicated to other processes during intervals other than when monitoring the accumulated alarm conditions to periodically delete one or more previously accumulated ordinary alarm conditions.

The above process has been described in connection with the escalation of ordinary alarm conditions into a critical condition. However, the process can readily be extended in a hierarchical fashion to escalate alarm conditions at each successive degree of severity to the next level. For example, rather than assume only two degrees of severity, ordinary and critical, now assume three levels, ordinary, critical and urgent. In accordance with the above-described process, ordinary alarm conditions are escalated into a critical condition by the steps depicted in FIG. 2. A succession of critical conditions could then be escalated into an urgent alarm condition by the same process, using the same or different values for the variables AlrmThd and RmvAmt in eq. (1).

The above-described process implicitly assumes that the ordinary alarm conditions all possess the same degree of severity. However, such may not necessarily be the case. Under some circumstances, it may be desirable to escalate ordinary alarm conditions of different degrees of severity in a single process. Ordinary alarm conditions of different degrees of severity may be escalated using the above described process by weighting the alarm conditions in accordance with their degree of severity. To that end, eq. (3) would be replaced by the following relationship:

$$toCnt=totAlarmCnt+AlrmWt \quad (5)$$

where:

AlrmWt represents the weight accorded to each alarm condition. In this way, a lesser number of higher weight alarm conditions trigger escalation of a critical alarm.

It is to be understood that the above-described embodiments are merely illustrative of the principles of the invention. Various modifications and changes may be made thereto by those skilled in the art which will embody the principles of the invention and fall within the spirit and scope thereof.

What is claimed is:

1. A method for escalating a succession of ordinary alarm conditions occurring over time into a critical alarm condition, comprising the steps of:

(a) accumulating over time each ordinary alarm condition upon its occurrence by adding each successive alarm condition to the alarm conditions that occurred during a previous time interval;

(b) deleting, upon the occurrence of each successive ordinary alarm condition, a prescribed number of accumulated ordinary alarm conditions that occurred over time in accordance with how much time has elapsed since a previous ordinary alarm condition and a critical alarm threshold; and (c) escalating the accumulated ordinary alarm conditions into a critical alarm condition when the number of accumulated ordinary alarm conditions at least equals the critical alarm threshold.

2. The method according to claim 1 wherein the steps (a)–(c) are repeated in sequence.

3. The method according to claim 1 wherein a succession of critical alarm conditions are escalated into an urgent alarm, comprising the steps of:

(a) accumulating each critical alarm conditions upon its occurrence;

(b) deleting, upon the occurrence of each critical alarm condition, a prescribed number of accumulated critical alarm conditions in accordance with how much time has elapsed since escalation into a critical alarm condition; and (c) escalating the accumulated critical alarm conditions into an urgent alarm condition when the number of accumulated critical alarm conditions at least equals a critical alarm threshold.

4. The method according to claim 3 wherein 1 wherein the prescribed number of deleted critical alarm conditions is established from the relationship:

$$amntToRemv=((Current\ GMT-lastAlrmGMT)/AlrmThd)*RmvAmt$$

where:

amntToRemv represents a quantity of critical alarm conditions to be deleted;

Current GMT is corresponds to a current time in seconds;

lastAlrmGMT corresponds to a time, in seconds, when critical alarm conditions were last deleted;

AlrmThd represents an alarm condition threshold and corresponds to a time, in seconds, when a critical alarm condition should be deleted; and RmvAmt corresponds to a quantity of number of alarm conditions to be deleted upon the occurrence of each critical alarm condition.

5. The method according to claim 1 wherein ordinary alarm conditions of varying degrees of severity are escalated by weighting each ordinary alarm condition in accordance with its degree of severity.

6. A method for escalating a succession of ordinary alarm conditions into a critical alarm condition, comprising the steps of:

(a) accumulating each ordinary alarm condition upon its occurrence;

(b) deleting, upon the occurrence of each ordinary alarm condition, a prescribed number of accumulated ordinary alarm conditions in accordance with how much time has elapsed since a previous ordinary alarm condition; wherein the prescribed number of deleted ordinary alarm conditions is established from the relationship:

$$amntToRemv=((Current\ GMT-lastAlrmGMT)/AlrmThd)*RmvAmt$$

where:

amntToRemv represents a quantity of ordinary alarm conditions to be deleted;

Current GMT is corresponds to a current time in seconds;

lastAlrmGMT corresponds to a time, in seconds, when ordinary alarm conditions were last deleted;

AlrmThd represents an alarm condition threshold and corresponds to a time, in seconds, when an ordinary alarm condition should be deleted; and RmvAmt corresponds to a quantity of number of ordinary alarm conditions to be deleted upon the occurrence of each alarm condition; and (c) escalating the accumulated ordinary alarm conditions into a critical alarm condition when the number of accumulated ordinary alarm conditions at least equals a critical alarm threshold.

* * * * *